United States Patent [19]

Klamandt et al.

[11] 4,256,235

[45] Mar. 17, 1981

[54] DRUM FOR LAUNDRY HANDLING MACHINE

[75] Inventors: Herbert F. Klamandt, Altena, Fed. Rep. of Germany; Jacques Colley, Liege, Belgium

[73] Assignee: ITT Industries, Inc., New York, N.Y.

[21] Appl. No.: 743,895

[22] Filed: Nov. 22, 1976

Related U.S. Application Data

[63] Continuation of Ser. No. 607,747, Aug. 26, 1975, abandoned.

[51] Int. Cl.[3] ..... B65D 6/24

[52] U.S. Cl. ..... 220/4 F; 220/306; 220/346

[58] Field of Search ..... 220/4 F, 5 R, 5 A, 306, 220/345, 346, 350

[56] References Cited

U.S. PATENT DOCUMENTS

| | | | |
|---|---|---|---|
| 519,578 | 5/1894 | Harlbut | 220/350 |
| 1,285,428 | 11/1918 | Sheer | 220/346 |
| 1,429,220 | 9/1922 | Blanton | 220/5 R |
| 3,107,997 | 2/1938 | Horsley | 220/345 |
| 3,283,944 | 11/1966 | Richardson | 220/346 |
| 3,528,583 | 9/1970 | Taylor | 220/4 F |

FOREIGN PATENT DOCUMENTS

| | | | |
|---|---|---|---|
| 388181 | 6/1965 | Switzerland | 220/306 |

*Primary Examiner*—George E. Lowrance
*Attorney, Agent, or Firm*—John T. O'Halloran

[57] ABSTRACT

This invention relates to a machine for handling laundry such as for instance a washing, rinsing or drying machine. The machine structure according to the invention is particularly suitable for small portable washing machines of the type employing a rotating drum. The drum is provided with a toothed ring or a friction drive band mounted on the periphery of the drum. An electric motor having a pinion or friction drive wheel positioned to engage the toothed ring or friction drive band on the drum is mounted inside the top cover of the machine together with the motor control unit. With this mounting arrangement the drive member and control unit are readily accessible for adjustment and maintenance from the top of the machine. Moreover, the chance of splashing or leakage water reaching the driving means is considerably smaller than in machines wherein these means are for instance arranged below the drum.

3 Claims, 5 Drawing Figures

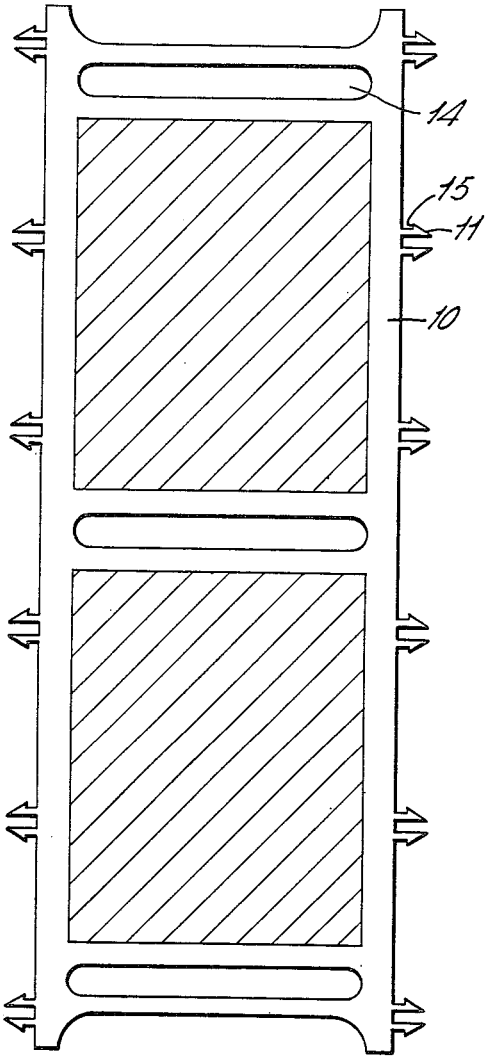
FIG. 2.
FIG. 3.
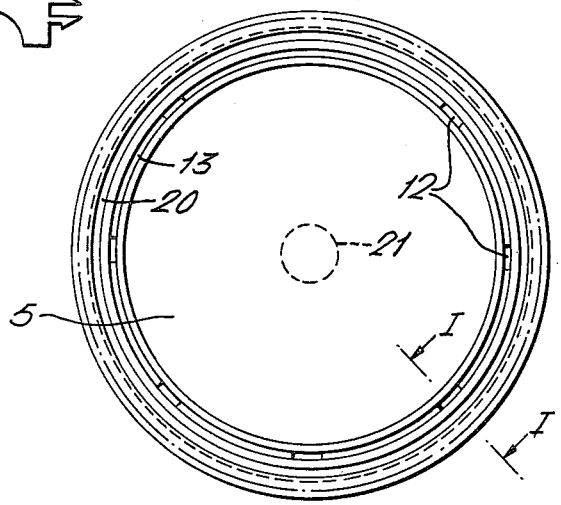

DRUM FOR LAUNDRY HANDLING MACHINE

This is a continuation of application Ser. No. 607,747, filed Aug. 26, 1975, now abandoned.

BACKGROUND OF THE INVENTION

The invention relates to a machine for handling laundry, such as for instance a washing, rinsing or drying machine.

Machines for handling laundry, such as the washing thereof, are generally known. They are constituted by a vat containing water, washing products and laundry, the relative motion of these three elements ensuring the cleaning of the laundry. This relative motion may be produced by giving the vat shaped as a drum a rotating or tumbling motion or by stirring the water by means of a stirring member mounted on a side wall or at the bottom of the stationary vat.

In the machines known, parts of the driving means, such as an electric motor, a gear transmission or a belt transmission are always mounted below or beside the vat, while the actuating means are mounted on the front or rear side of the machine. This necessitates the use of mechanical and/or electric connections able to transmit control signals and driving power in order to interconnect said unassembled parts. This building structure does not excel by way of simplicity and good accessibility, the manufacture and the maintenance of such machines being therefore relatively expensive.

SUMMARY OF THE INVENTION

The object of the invention is to provide a machine for handling laundry wherein the actuating means and all driving members, with one exception, are housed inside the cover of the machine. In this way the actuating and driving members may be built as a single assembled unit of a simple, relatively cheap structure, with an excellent accessibility and the maintenance of which is simple. Moreover, the charge of splashing or leakage water reaching the driving means is considerably smaller than in machines wherein these means are for instance arranged below the drum. The machine structure according to the invention is particularly suitable for smaller portable washing machines.

The machine according to the invention is characterized in that it is provided with a drum having at least one driven element which can cooperate with a driving element housed inside the cover of the machine, said driving element being in its turn driven by a motor which is fed via control means, said control means as well as all driving means, said driven element of the drum excepted, being housed inside the cover of the machine.

To further simplify the machine and the manufacture thereof and to further reduce its cost, it is advantageous not to secure the side walls of the drum and the casing by a welding or by a fastening spinning operation, but to make these parts in such a manner that they can be interlocked. According to the invention this is made possible due to the fact that the drum includes two circular side walls made of a synthetic material and provided at the inside of their periphery with a first axial groove having in its bottom a series of openings extending towards the outside of said drum, that the casing of said drum consists of a flat mostly perforated plate of which two opposite edges are provided with protrusions having stud portions, said protrusions being able, after said plate has been bent, to cooperate with said openings when said edges are slid into said first groove, the stud portions hereby being caught behind parts of said side walls.

BRIEF DESCRIPTION OF THE DRAWINGS

The above mentioned and other objects and features of the invention will become more apparent and the invention itself will be best understood by referring to the following description of an embodiment taken in conjunction with the accompanying drawings wherein:

FIG. 2 is a top view of the developed casing of the drum;

FIG. 3 is a side view of one of the side walls of the drum;

DESCRIPTION OF THE PREFERRED EMBODIMENTS

Figure 1:
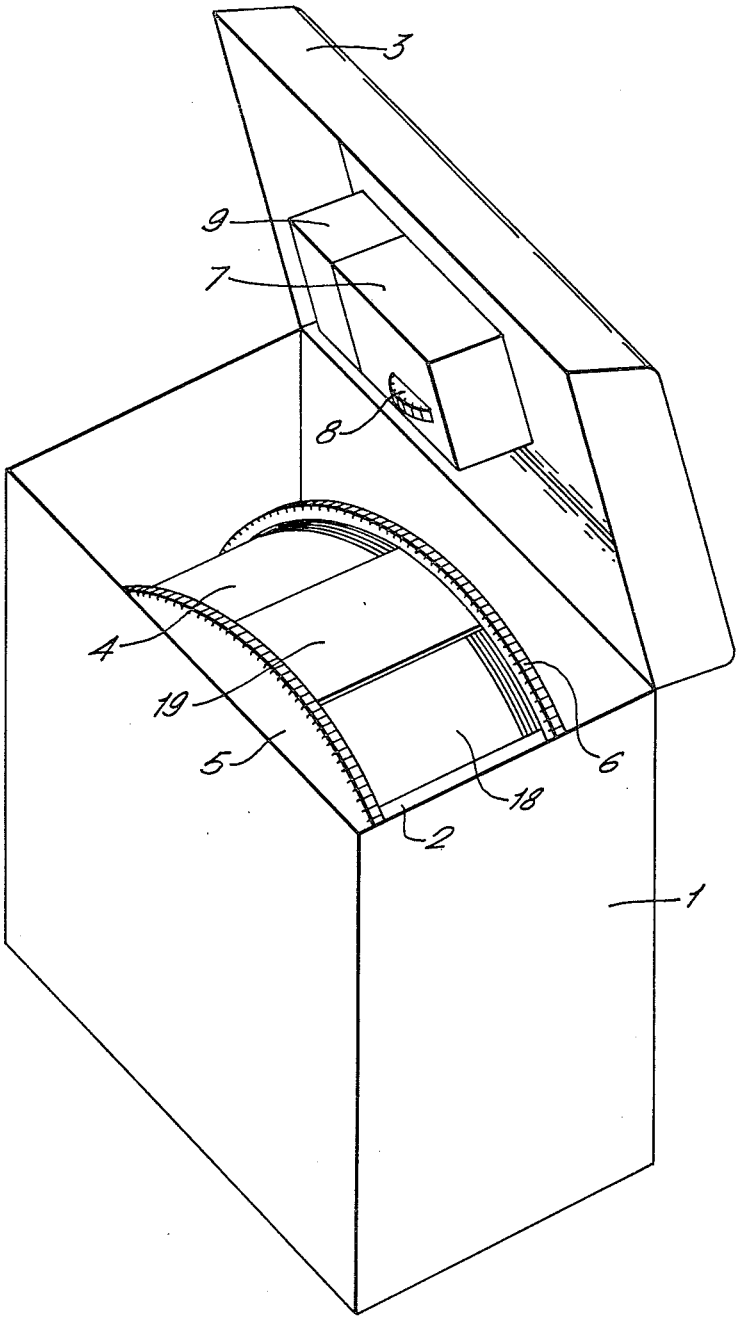
FIG. 1 is a perspective schematic view of a washing machine according to the invention.
Figure 4:
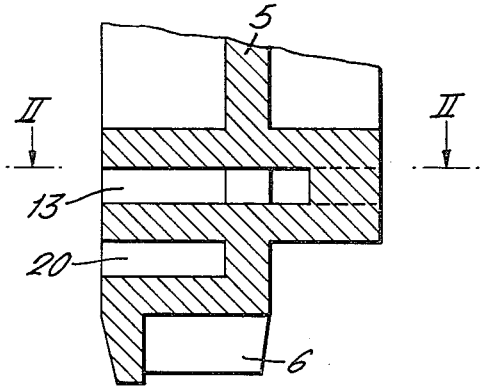
FIG. 4 is a cross-section on an enlarged scale of the edge portion of a side wall, this cross section being taken along line I—I in FIG. 3.

FIG. 1 shows an embodiment of a washing machine according to the invention. This machine consists of the vat 1, the drum 2 and the cover 3. The drum 2 which mainly consists of a cylindrical casing 4 and two circular side walls 5 is rotatably mounted due to the side walls being each provided with a centrally located pivot pin which is journalled in a bearing provided at the inner side of a wall of the vat.

The drum may be driven due to its peripheral outer edge being provided with a toothed ring 6. Preferably this toothed ring forms part of a side wall 5; the side wall 5 and the toothed ring 6 may thus be made of synthetic material as a single unit.

All other parts of the driving means are housed inside the cover and may consist of an electric motor and of a speed reduction stage in the form of a belt or gear transmission, both the motor and the reduction stage forming part of the driving unit 7 driving the pinion 8.

When closing the cover 3 the pinion 8 engages with the toothed ring 6 so that in this position the motor can drive the drum. The actuating and control means 9 which for instance consist of a program selection switch and a time clock may be realized so as to form one unit with the driving means. In this way a very simple washing machine structure is obtained, hereby consequently reducing the manufacturing costs and simplifying the maintenance. These advantages are also due to the very good accessibility. In case of a machine disturbance it is even possible for a service man to replace the whole cover housing the driving and control members by another cover. It is further possible to mount inside the cover a security switch which only closes when the cover is fully closed and which is included in the electricity supply circuitry. In this case the operation of the washing machine can only be started when the cover is closed.

Figure 5:
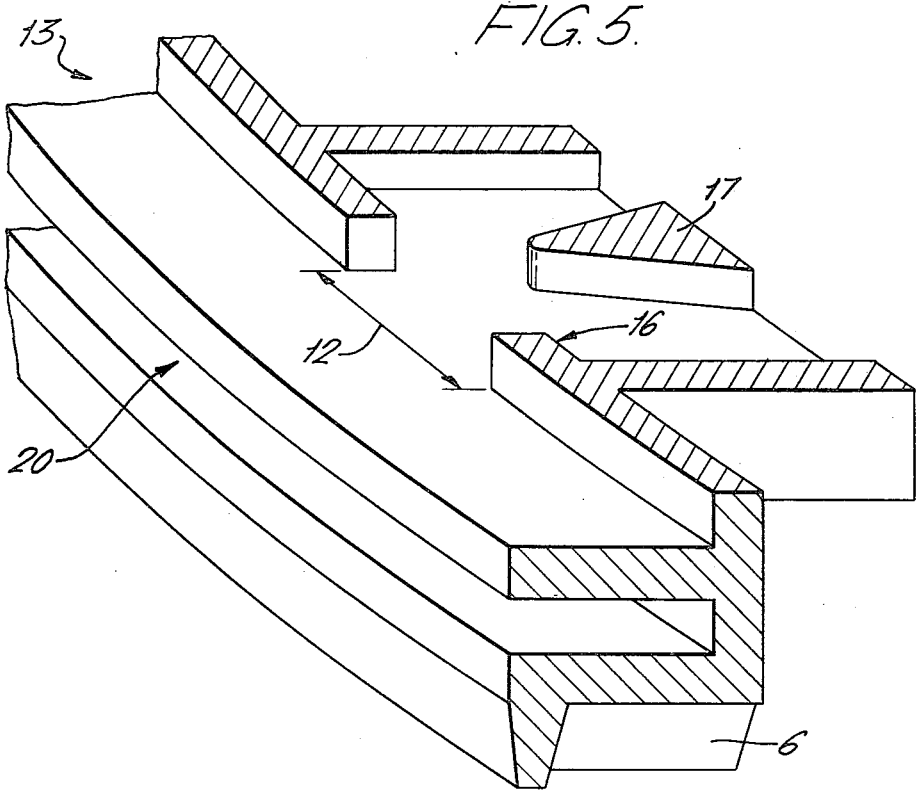
FIG. 5 is a perspective view, on an enlarged scale, of a cross-section of an edge portion of a side wall at the location of a fixing opening, this cross-section being taken along line II—II in FIG. 4.

In order to still further simplify the manufacture of the washing machine, it is preferable not only to make the side walls 5 of the drum of a synthetic material, but also to do the same with the partly perforated casing 4. The assembly of the casing and the two side walls in such a manner that a drum is formed may then be performed by interlocking. To this end the casing 4, shown developed in FIG. 2, is provided along its lateral edges 10 to be secured to the side walls 5 with a number of pairs of protrusions 11. These somewhat resilient protrusions 11 can be slid into openings 12 (FIG. 3) made in the bottom of a circular groove 13 having a rectangular cross-section. This groove 13 is made in the peripheral edge of a side wall 5. The edge 10 of the casing 4 which has reinforcing ribs 14 and which is made in the shape of a flat piece is slid into the closely fitting groove 13 after having been bent to a cylindrical form. Hereby protrusions 11 penetrate into the openings 12. This sliding action is continued until the stud portions 15 of the protrusions 11 hook behind parts 16 (FIG. 5) of the side wall, the casing 4 being then fixedly secured to this side wall 5. After each of the edges casing has thus been secured to a side wall a complete drum is obtained.

During the sliding action each of the tapering portions 17 of a side wall pushes the protrusions of a pair away from each other and in this way contributes to the stud portions 15 hooking behind the parts 16.

The casing 5 has a filling opening 18 which may be closed by a door 19. This door can slide back and forth in a second groove 20 in the edge of the side wall, this second groove having a larger diameter than groove 13. The door can be kept closed by a device not further detailed, such as for instance a spring-loaded hook which in the same way as a lock engages into an opening.

It is clear that the above described structure may be modified without departing from the spirit of the invention. For instance, it is possible to provide both side walls with a toothed ring driven by a pinion. It is also possible to mount the drum in such a way that it is rotatable about a vertical axis. In all cases a structure realized according to the characteristic features of the invention provides a machine the manufacture and the maintenance of which are not expensive.

While the principles of the invention have been described above in connection with specific apparatus, it is to be clearly understood that this description is made only by way of an example and not as a limitation on the scope of the invention.

What is claimed is:

1. A washing machine drum particularly constructed for a low cost laundry machine comprising:

a pair of circular shaped side walls made from a synthetic material;

a partially perforated casing made from a synthetic material positioned between and joining said side walls forming a cylindrical shaped member enclosing the space between said side walls except for an open portion; and a door for said open portion;

at least one of said side walls having toothed ring portion formed on one outside edge thereof which is adapted to mate with a driving pinion associated with said laundry machine;

each of said side walls having a pair of slightly spaced apart circular grooves peripherally located adjacent its outer edge, the outer of each of said grooves being adapted to receive the opposing edges of said door and to allow for sliding movement of said door therein for opening and closing said open portion, and the inner of said grooves having a plurality of peripherally spaced openings formed through each of said side walls, each of said openings through said side walls having a first outer width, a pair of locking parts and a wider inner width, said casing having a plurality of pairs of spaced apart somewhat resilient stud-like protrusions formed on each lateral edge adapted to mate with said plurality of openings formed through said inner peripheral groove of said side walls, each of said stud-like protrusions having a tapered portion and a locking shoulder portion formed thereon adjacent its outer end, said protrusions being spaced apart by an amount which is less than said first outer width through said openings of said side walls and being adapted to be forced toward each other to penetrate through said first outer width of said openings and then to move outwardly whereby said locking shoulders hook onto and are supported on said locking parts of said openings through said side walls.

2. The drum as set forth in claim 1 wherein said each of said openings through said side walls includes an internally located tapering portion element spaced inwardly of said inner width portion adapted to cause said outer ends of said stud-like protrusions to be forced outwardly to ensure the locking of said locking shoulders and locking parts.

3. In a laundry handling machine, a drum means specifically adapted and constructed to provide a low cost element of a laundry machine, comprising two circular side walls made of a synthetic material and provided at the inside of their periphery with a circular groove having in its bottom a series of openings extending towards the outside of said drum, and said drum having a casing consisting of a flat, mostly perforated, plate of which two opposite edges are provided with protrusions having stud portions, said protrusions being able, after said plate has been bent, to operate with said openings when said edges are slid into said groove, the stud portions hereby being caught behind parts of said side walls, said protrusions are arranged in pairs, that the stud portions on the two protrusions of each said pair are provided on the outer sides of said two protrusions with respect to one another and that the protrusions of each said pair are pushed away from one another when slid into a said opening, due to the presence of a wedge-shaped member on the side wall.

* * * * *